US008096284B2

(12) United States Patent
Koidl et al.

(10) Patent No.: US 8,096,284 B2
(45) Date of Patent: Jan. 17, 2012

(54) METHOD FOR DETERMINING A RAIL PRESSURE SETPOINT VALUE

(75) Inventors: Stefan Koidl, Stuttgart (DE); Guido Baumann, Stuttgart (DE); Antoine Combelle, Korntal-Muenchingen (DE); Anthony Dieryckxvisschers, Paris (FR); Jean-Daniel Mettetal, Farmington Hills, MI (US); Pierre Mathis, Esslingen (DE); Enrique Naupari, Kernen I.R. (DE); Martin Schwab, Sindelfingen (DE); Roland Hafner, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 365 days.

(21) Appl. No.: 12/308,205

(22) PCT Filed: Jul. 16, 2007

(86) PCT No.: PCT/EP2007/057295

§ 371 (c)(1),
(2), (4) Date: Jul. 30, 2009

(87) PCT Pub. No.: WO2008/019919

PCT Pub. Date: Feb. 21, 2008

(65) Prior Publication Data

US 2009/0320798 A1 Dec. 31, 2009

(30) Foreign Application Priority Data

Aug. 18, 2006 (DE) ..... 10 2006 038 848
Sep. 28, 2006 (DE) ..... 10 2006 045 923

(51) Int. Cl.
*F02M 59/36* (2006.01)

(52) U.S. Cl. ..... 123/458; 701/102

(58) Field of Classification Search ..... 123/457, 123/458, 494; 701/101, 104, 103, 115
See application file for complete search history.

(56) References Cited

U.S. PATENT DOCUMENTS

| | | | | |
|---|---|---|---|---|
| 5,483,940 | A * | 1/1996 | Namba et al. | 123/497 |
| 5,609,140 | A * | 3/1997 | Kramer et al. | 123/497 |
| 5,723,780 | A * | 3/1998 | Miwa et al. | 73/114.43 |
| 6,035,829 | A * | 3/2000 | Hartke et al. | 123/447 |
| 6,050,240 | A * | 4/2000 | Saiki et al. | 123/357 |
| 6,209,521 | B1 * | 4/2001 | Rembold et al. | 123/456 |
| 6,223,720 | B1 * | 5/2001 | Kramer et al. | 123/357 |
| 6,868,826 | B1 * | 3/2005 | Oono | 123/339.1 |
| 7,472,690 | B2 * | 1/2009 | Takayanagi et al. | 123/446 |
| 7,670,261 | B2 * | 3/2010 | Halleberg et al. | 477/109 |
| 2003/0062030 | A1 * | 4/2003 | Oashi | 123/496 |
| 2011/0000463 | A1 * | 1/2011 | Kokotovic et al. | 123/457 |
| 2011/0120417 | A1 * | 5/2011 | Jung et al. | 123/447 |

FOREIGN PATENT DOCUMENTS

| | | |
|---|---|---|
| DE | 197 31 201 | 1/1999 |
| DE | 100 12 024 | 9/2001 |
| DE | 103 43 758 | 4/2005 |
| EP | 0 930 426 | 7/1999 |
| JP | 2005-527726 | 9/2005 |
| WO | WO 2004/094806 | 11/2004 |

* cited by examiner

*Primary Examiner* — Thomas Moulis
(74) *Attorney, Agent, or Firm* — Kenyon & Kenyon LLP

(57) ABSTRACT

In a method for determining a rail pressure setpoint value for a high-pressure rail of an internal combustion engine, the rail pressure setpoint value is modified to a maximum degree using a maximum gradient for changing the rail pressure setpoint value, and the maximum gradient is read from a characteristics map as a function of operating parameters of the internal combustion engine. The operating parameters include an engaged gear of a gear-change transmission.

8 Claims, 3 Drawing Sheets

METHOD FOR DETERMINING A RAIL PRESSURE SETPOINT VALUE

BACKGROUND OF THE INVENTION

1. Field of the Invention

The present invention relates to a method for determining a rail pressure setpoint value for a high-pressure rail of an internal combustion engine.

2. Description of Related Art

To ensure a long service life of injection systems for diesel engines, the observance of the design goal regarding the failure of the components is ensured on the basis of a collective load measurement in the vehicle.

In engine manufacturing, there is a trend to operate injection systems at higher pressures than is currently customary. Therefore, the object to comply with the required failure rate without resorting to expensive construction means is more difficult to achieve. Presently, measures such as a suitable selection of materials, for example, are used for achieving a higher service life of components at higher operating pressures. In addition, measures may be taken during engine parameter calibration, for example, designing a rail pressure characteristics map, high-pressure regulation, etc. A number of measures with respect to calibration affect the engine characteristics, in particular its emissions and its performance.

BRIEF SUMMARY OF THE INVENTION

One object of the present invention is to increase the service life of components without modifying their design.

This object is achieved by a method for determining a rail pressure setpoint value for a high-pressure rail of an internal combustion engine, the rail pressure setpoint value being modified to a maximum degree using a maximum gradient for changing the rail pressure setpoint value and the maximum gradient being read from a characteristics map as a function of operating parameters of the internal combustion engine, the operating parameters including an engaged gear of a gear-change transmission and/or a rail pressure actual value.

The rail pressure setpoint value is the pressure which is regulated in the rail (accumulator) as a specified setpoint value. The internal combustion engine may be either a diesel engine or a gasoline engine. The operating parameters of the internal combustion engine are measured or modeled physical variables such as setpoint rotational speed, actual rotational speed, setpoint injected quantity, actual injected quantity, actual rail pressure, engine system quantity, or different temperature or pressure variables of an internal combustion engine. A characteristics map links input values to output values and may be stored in the form of a one-dimensional or multidimensional table, for example, in a memory of a control unit.

It is preferably provided that the value of the maximum gradient is limited downward to a minimum value and/or upward to a maximum value. The maximum value of the gradient is thus limited in both directions; excessively high or excessively low gradients, in particular gradients <0, are thus ruled out.

The above-mentioned object is also achieved by a device, in particular a control unit of an internal combustion engine having means for determining a rail pressure setpoint value for a high-pressure rail of an internal combustion engine, the rail pressure setpoint value being modified to a maximum degree using a maximum gradient for changing the rail pressure setpoint value, and the maximum gradient being read from a characteristics map as a function of operating parameters of the internal combustion engine, the operating parameters including an engaged gear of a gear change transmission and/or a rail pressure actual value.

The above-named object is also achieved via a computer program having program code for carrying out all steps of a method according to the present invention when the program is executed on a computer.

DETAILED DESCRIPTION OF THE INVENTION

Figure 1:
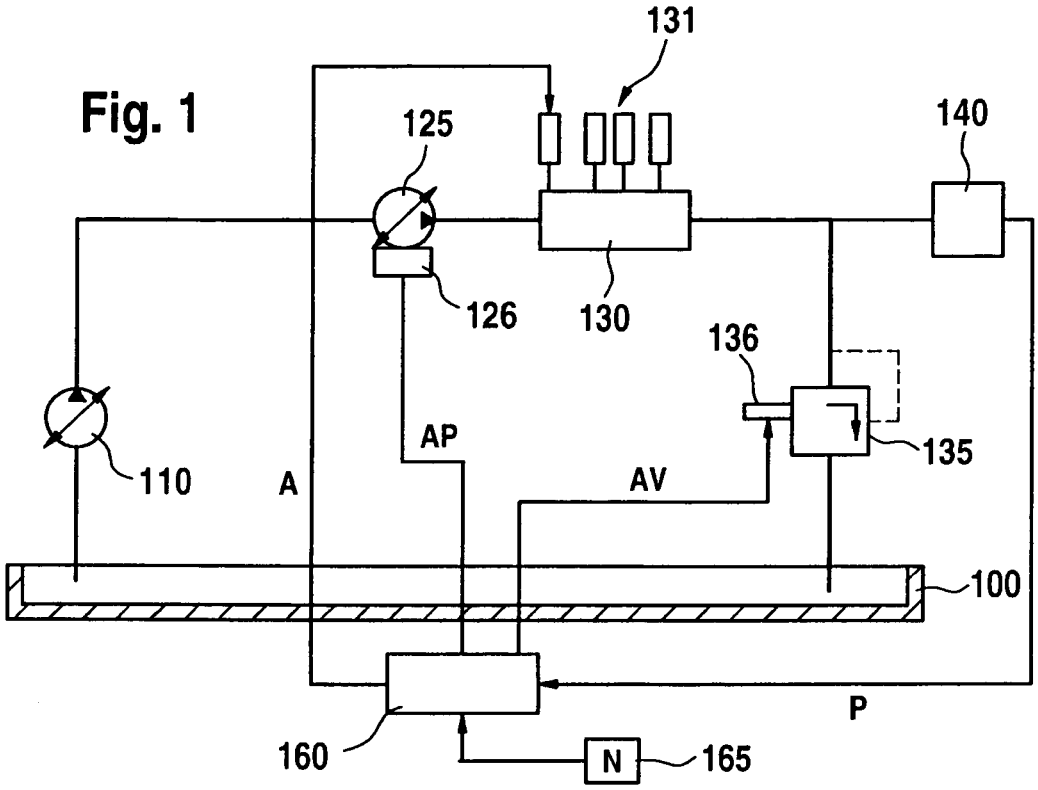
FIG. 1 shows a block diagram of a fuel metering system.

FIG. 1 shows the components, necessary for understanding the present invention, of a fuel supply system of an internal combustion engine having high-pressure injection. The depicted system is normally referred to as a common rail system. A fuel reservoir is labeled 100. It is connected to a high-pressure pump 125 via a pre-supply pump 110. High-pressure pump 125 may include at least one element shut-off valve. High-pressure pump 125 is connected to a rail 130. Rail 130 is also known as an accumulator and is connected to different injectors 131 via fuel lines. The time-dependent pressure P_rail_actual(t) in the rail, i.e., in the entire high-pressure zone, is detected by sensor 140. The time-dependence is indicated by the appended variable (t). Rail 130 is connectable to fuel reservoir 100 via a pressure regulating valve 135. Pressure regulating valve 135 is controllable with the aid of a coil 136. A controller 160 sends a trigger signal AP to element shut-off valve 126, a trigger signal A to injectors 131, and a signal AV to pressure regulating valve 136. Controller 160 processes different signals of various sensors 165, which characterize the operating state of the internal combustion engine and/or of the motor vehicle propelled by this internal combustion engine. Such an operating state is, for example, actual rotational speed n_actual of the internal combustion engine.

This device operates in the following way: The fuel in the reservoir is pumped by pre-supply pump 110 to high-pressure pump 125. High-pressure pump 125 pumps the fuel from the low-pressure zone into the high-pressure zone. High-pressure pump 125 builds up a very high pressure in rail 130. Normally, in systems for spark-ignition internal combustion engines, pressure values of approximately 30 bar to 100 bar are achieved, and in self-ignition internal combustion engines, pressure values of approximately 1000 bar to 2000 bar are achieved. The fuel may be metered to the individual cylinders of the internal combustion engine at high pressure via injectors 131. Rail pressure actual value P_rail_actual(t) is detected in the rail, i.e., the entire high-pressure zone by sensor 140, and is compared with a rail pressure setpoint value P_rail_setpoint(t) in controller 160. Pressure regulating valve 135 is controlled as a function of this comparison. If little fuel is needed, the pumping capacity of high-pressure pump 125 may be gradually reduced via appropriate control of the element shut-off valve.

Figure 2A:
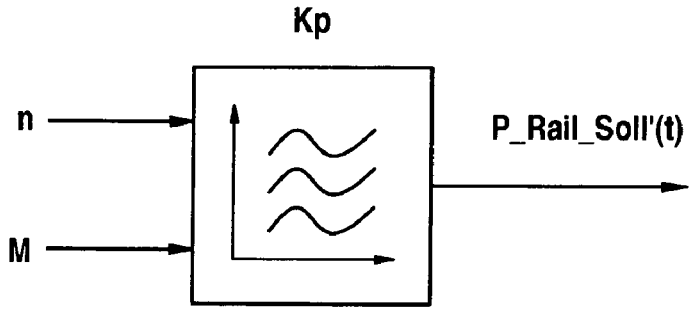
FIG. 2 shows a schematic diagram of the setpoint determination of the rail pressure.
Figure 2B:
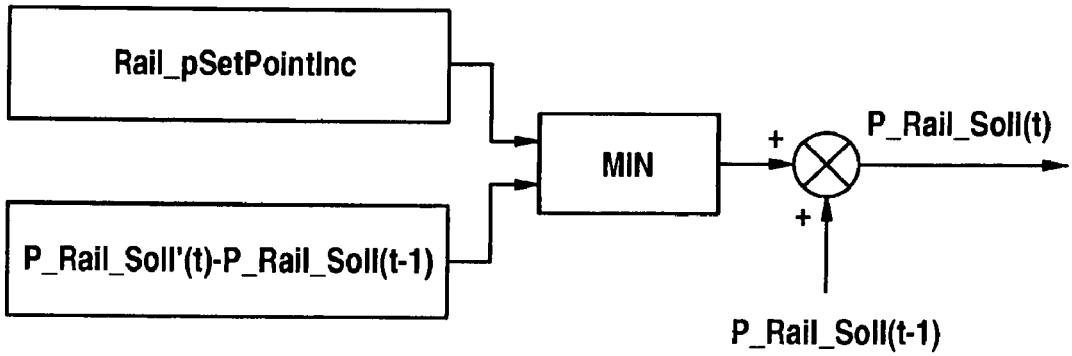

For this purpose, rail pressure setpoint value P_rail_setpoint(t) is read from a characteristics map which may contain the most diverse parameters of the operating state of the internal combustion engine. When the internal combustion engine is operated dynamically, i.e., when parameters such as the torque request or rotational speed are modified, the rail pressure setpoint value is modified not abruptly, but with a time delay. This is shown as a schematic diagram in FIG. 2. Operating parameters of the internal combustion engine such as rotational speed n, requested engine torque M and the like enter into a characteristics map KP, so that a setpoint value for the rail pressure P_rail_setpoint'(t) may be read from characteristics map KP. Setpoint value P_rail_setpoint(t−1) from the previous computational step is deducted from the recently read P_rail_setpoint'(t) from characteristics map Kp and compared to the gradient rail_P_setpointinc. The minimum of the two values is then added to the setpoint value P_rail_setpoint(t−1) from the previous computing step and thus forms the present setpoint value P_rail_setpoint(t).

Figure 3:
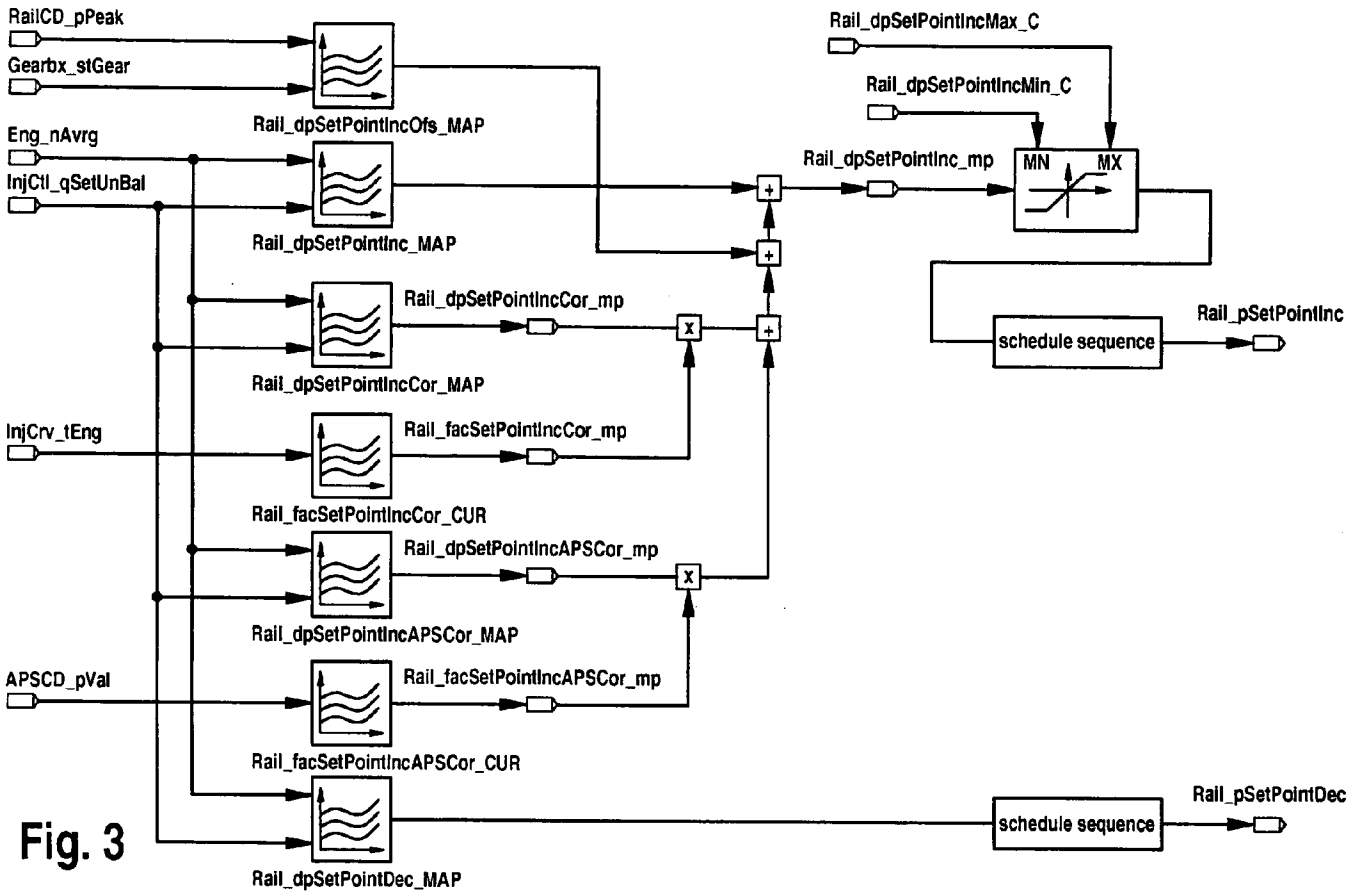
FIG. 3 shows a schematic diagram for determining the gradient of the rail pressure.

FIG. 3 shows a schematic diagram for determining the value of the maximum gradient rail_P_setpointinc for modifying rail pressure setpoint value P_rail_setpoint(t). Methods of the related art provide a rail pressure setpoint value characteristics map which corresponds to the requirements at steady-state operating points of the engine. In dynamic engine use, the points of the rail pressure setpoint value characteristics map are connected with the aid of a rail pressure gradient characteristics map for the pressure increase (for example, in bar/s) rail_dpsetpointinc_map for regulation and noise-related reasons. This pressure increase gradient characteristics map results as a function of the engine system quantity injctl_qsetunbal and the engine speed eng_navrg.

The present exemplary embodiment of the present invention provides for performing, in a characteristics map rail_dpsetpointincofs_map, a gear-dependent gearbx_stgear, an actual rotational speed-dependent n_actual, and a rail pressure actual value-dependent railCD_ppeak reduction in the rail pressure increase gradient characteristics map rail_dpsetpointinc_map with the purpose of attaining the setpoint values slower and slower at higher prevailing rail pressures.

The dependence on the rail pressure actual value permits a direct intervention in the variable to be influenced (without passing through the system quantity). Due to the gear-dependent selective use option and the rail pressure actual value dependence, the variable is influenced only at lower gears, for example, and the non-relevant pressure ranges are excluded.

In order to prevent excessively high increase gradients or increase gradients ≦0 due to erroneous calibration, a limitation on both sides is calibratable (rail_dpsetpointincmax_C and rail_dpsetpointincmin_C).

The effect of this gear-dependent rail pressure gradient reduction characteristics map rail_dpsetpointincofs_map for the pressure increase is equivalent to that of a PT1 filter.

By suitably selecting the "reduction gradient," the effects on the engine behavior may be kept low.

What is claimed is:

1. A method for adjusting a rail pressure setpoint value for a high-pressure rail of an internal combustion engine, comprising:

obtaining a maximum gradient for adjusting the rail pressure setpoint value, wherein the maximum gradient is read from a characteristics map as a function of at least one operating parameter of the internal combustion engine, wherein the at least one operating parameter includes an engaged gear of a gear-change transmission; and modifying the rail pressure setpoint value to a maximum degree using the maximum gradient for changing the rail pressure setpoint value.

2. The method as recited in claim 1, wherein the at least one operating parameter further includes an actual value of the rail pressure actual value.

3. The method as recited in claim 1, wherein the at least one operating parameter further includes an actual rotational speed of the internal combustion engine.

4. The method as recited in claim 1, wherein the at least one operating parameter further includes an engine system quantity of the internal combustion engine.

5. The method as recited in claim 1, wherein the value of the maximum gradient is limited by a lower limit of a predetermined minimum value.

6. The method as recited in claim 1, wherein the value of the maximum gradient is limited by an upper limit of a predefined maximum value.

7. A control unit for adjusting a rail pressure setpoint value for a high-pressure rail of an internal combustion engine, comprising:

an arrangement configured to obtain a maximum gradient for adjusting the rail pressure setpoint value, wherein the maximum gradient is read from a characteristics map as a function of at least one operating parameter of the internal combustion engine, and wherein the at least one operating parameter includes an engaged gear of a gear-change transmission; and an arrangement configured to modify the rail pressure setpoint value to a maximum degree using the maximum gradient for changing the rail pressure setpoint value.

8. A computer-readable storage medium storing a computer program having a plurality of codes which, when executed on a computer, control a method for adjusting a rail pressure setpoint value for a high-pressure rail of an internal combustion engine, the method comprising:

obtaining a maximum gradient for adjusting the rail pressure setpoint value, wherein the maximum gradient is read from a characteristics map as a function of at least one operating parameter of the internal combustion engine, wherein the at least one operating parameter includes an engaged gear of a gear-change transmission; and modifying the rail pressure setpoint value to a maximum degree using the maximum gradient for changing the rail pressure setpoint value.

* * * * *